US006694870B1

(12) United States Patent
Pietikäinen et al.

(10) Patent No.: US 6,694,870 B1
(45) Date of Patent: Feb. 24, 2004

(54) METHOD FOR LEADING A WEB BETWEEN CALENDAR NIPS, AND A CALENDAR

(75) Inventors: Reijo Pietikäinen, Järvenpää (FI); Vesa Ijäs, Viiala (FI); Pekka Koivukunnas, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/018,123

(22) PCT Filed: Jun. 6, 2000

(86) PCT No.: PCT/FI00/00502

§ 371 (c)(1),
(2), (4) Date: Dec. 14, 2001

(87) PCT Pub. No.: WO00/79049

PCT Pub. Date: Dec. 28, 2000

(30) Foreign Application Priority Data

Jun. 17, 1999 (FI) ..... 991393

(51) Int. Cl.[7] ..... B30B 15/34; B30B 15/20

(52) U.S. Cl. ..... 100/38; 100/74; 162/207

(58) Field of Search ..... 100/38, 43, 73, 100/74, 75, 161, 162 R; 162/206, 207, 290, 359, 375; 118/67, 68, 117, 118, 665; 427/361, 365, 366, 382; 8/149.3; 34/54, 115; 68/3 D

(56) References Cited

U.S. PATENT DOCUMENTS

| | | | | | |
|---|---|---|---|---|---|
| 3,838,000 | A | * | 9/1974 | Urbas | 162/207 |
| 4,642,164 | A | | 2/1987 | Hanhikoski et al. | 162/207 |
| 4,738,197 | A | | 4/1988 | Malkia | 100/38 |
| 4,786,529 | A | * | 11/1988 | Boissevain | 427/296 |
| 5,020,469 | A | | 6/1991 | Boissevain et al. | 118/67 |
| 5,163,365 | A | | 11/1992 | Taylor | 100/38 |
| 5,445,071 | A | * | 8/1995 | Winheim | 100/38 |
| 5,915,294 | A | * | 6/1999 | Nyberg | 100/38 |

FOREIGN PATENT DOCUMENTS

| | | |
|---|---|---|
| DE | 328786 | * 11/1920 |
| EP | 0380427 | 8/1990 |
| FI | 92850 | 9/1994 |

* cited by examiner

*Primary Examiner*—Allen Ostrager
*Assistant Examiner*—Jimmy Nguyen
(74) *Attorney, Agent, or Firm*—Steinberg & Raskin, P.C.

(57) ABSTRACT

In the method for leading a web between calendar roll nips (N), a web (W) is guided between the calender roll nips (N) in a loop which runs apart from the calender rolls, inside which loop an air pocket (3) is formed. The mass and/or beat flow in the air pocket (3) is prevented in the cross direction of the web by means of obstacles (5) placed in connection with the pocket.

18 Claims, 5 Drawing Sheets

METHOD FOR LEADING A WEB BETWEEN CALENDAR NIPS, AND A CALENDAR

FIELD OF THE INVENTION

The invention relates to a method for leading a web between calender roll nips. The invention also relates to a calender containing calender rolls that mutually form calender roll nips.

BACKGROUND OF THE INVENTION

In papermaking, a normal finishing procedure for the paper web is calendering, in which the paper web is passed through several successive calender roll nips. The calendering is conducted either as on-line calendering in the same papermaking line in which the paper has been produced from pulp suspension and dried, or the calendering can be conducted as a separate processing stage for a previously produced and reeled paper web.

In the calendering, the thickness of the paper web as well as the quality of the surface is affected by means of a linear load effective in the nip between the calender rolls. Furthermore, the calendering result is affected by the temperature and the moisture content of the web. By means of the linear load, the temperature and the moisture content of the paper web it is thus possible to reach a desired result by setting the aforementioned variables to a suitable level.

The calendering, whether it takes place as an on-line calendering in a paper machine or as an off-line process, is typically conducted in a multiroll calender, in which the calender roll nips are formed between superimposed calender rolls forming a stack. The web to be calendered travels along a winding path via these nips in such a manner that it is brought to the upper end of the stack of calender rolls, and it leaves the calender in the lower end of the stack of calender rolls. To stabilize the travel of the web and to cool down the web, so called take-out leading rolls are used on both sides of the stack of calender rolls, by means of which the web can be drawn straight to the side after the nip and guided to the following nip by means of the roll. Even though it is possible to better control the travel of the web in the calender by means of the take-out leading rolls, the problem is that the web dries when it travels in loops apart from the calender rolls on both sides of the stack of calender rolls. Especially in on-line applications, higher surface temperatures of the calender roll are required, which causes an overdrying problem in the paper. Because of this, it is often necessary to wet the paper again between the calender rolls, even if the paper were left in a suitably wet state in view of the calendering process in the drying section preceding the calendering, or if the paper were wetted again to the inlet moisture of calendering.

Inside the web loop guided by the take-out leading rolls, an air pocket is produced which can cause additional problems. When the web travels in the loop it evaporates moisture and heat at constant speed from its outer surface. On the inner surface of the web, i.e. on the side of the air pocket, the web, however, is stabilized to a thermodynamic balanced state with the air of the air pocket, i.e. no heat or moisture is transferred to the air pocket. This situation, however, only exists in the middle of the web. In the air pocket on the edge area of the web there prevails a descending gradient of both moisture content and temperature in the direction of the outer edges of the web, because of a lower temperature and air humidity prevailing outside. This uneven cross profile of the humidity and temperature in the pocket immediately causes a mass and heat flow in the edge area of the web from the web to the pocket through diffusion and conduction, respectively. These flows are thus directed away from the web, i.e. the air pocket dries and cools only the edge areas of the web, whereas on the opposite side of the web, i.e. on the side of the outer curve of the loop, the drying and cooling is considerably more uniform. This causes significant problems in the control of the cross profile of the web, and it can be assumed that the air pockets have a considerable significance in the profile defects in the edge of the web detected in different measurements.

The calender equipped with take-out leading rolls also contain temperature deviations caused by other factors. For example the heat generation of the take-out leading rolls themselves at the location of the bearings located inwardly from the ends of the rolls, cause clear heat peaks in the otherwise even middle area.

Furthermore, present multiroll calenders evaporate water efficiently, because the aim is to use high surface temperatures of the rolls. The wetting requirement is typically 0.5–1.5 g/m$^2$ of paper. In addition to profile defects, the problem in multiroll calenders is the wetting efficiency by present wetting methods. The heating up of the rolls also involves a poor coefficient of efficiency.

U.S. Pat. No. 4,642,164 discloses a manner for affecting the conditions prevailing inside the air pocket by placing a steam box therein from which it is possible to supply desired amounts of steam in the lateral direction of the web in zones on the inner surface of the web. Despite of the steam supply, the drying of the edges poses a problem, and in order to attain the best result, it should be possible to supply steam very accurately in the outer edge zones. The efficiency in this wetting inside the air pocket suffers from the fact that heat and moisture escape outside the pocket.

Furthermore, Finnish patent 92850 discloses an encapsulated supercalender, wherein the moisture level can be increased around the entire calender.

OBJECTS AND SUMMARY OF THE INVENTION

It is an aim of the invention to eliminate the aforementioned drawbacks and to introduce a method by means of which the profile defects can be better avoided and wetting and/or heating can be enhanced in a relatively simple manner. Another aim is to be able to better control the calendering process by means of procedures conducted inside the web loops that run outside the stack of calender rolls. In the air space inside the web loop, the flows are restricted in the transverse direction of the web. An efficient restriction is attained by closing both open ends of the pocket formed by the web loop. In a substantially closed space it is possible to much more efficiently affect the web passing by as well as the roll located by the space, and to prevent the development of gradients in the edge areas of the web as well as to prevent the drying of the edge areas.

It is also an aim of the invention to present a device for guiding a web between calender roll nips, by means of which it is possible to avoid the drawbacks due to the previous structures. To attain this purpose, the device is primarily characterized in what will be presented in the characterizing part of the appended claim 11. The device comprises obstacles placed in connection with the web loops outside the stack of calender rolls, which obstacles are arranged to prevent the flow of air in the air pocket in the transverse direction of the web. The obstacles can be walls closing the air pockets entirely or partly at the ends, and/or partitioning walls closing the pocket likewise either partly or entirely in its cross direction. As for the other preferred embodiments of the device according to the invention, reference is made to the appended dependent device claims.

BRIEF DESCRIPTION OF THE DRAWINGS

In the following description the invention will be described in more detail with reference to the appended drawings. In the drawings

DETAILED DESCRIPTION OF THE INVENTION

Figure 1:
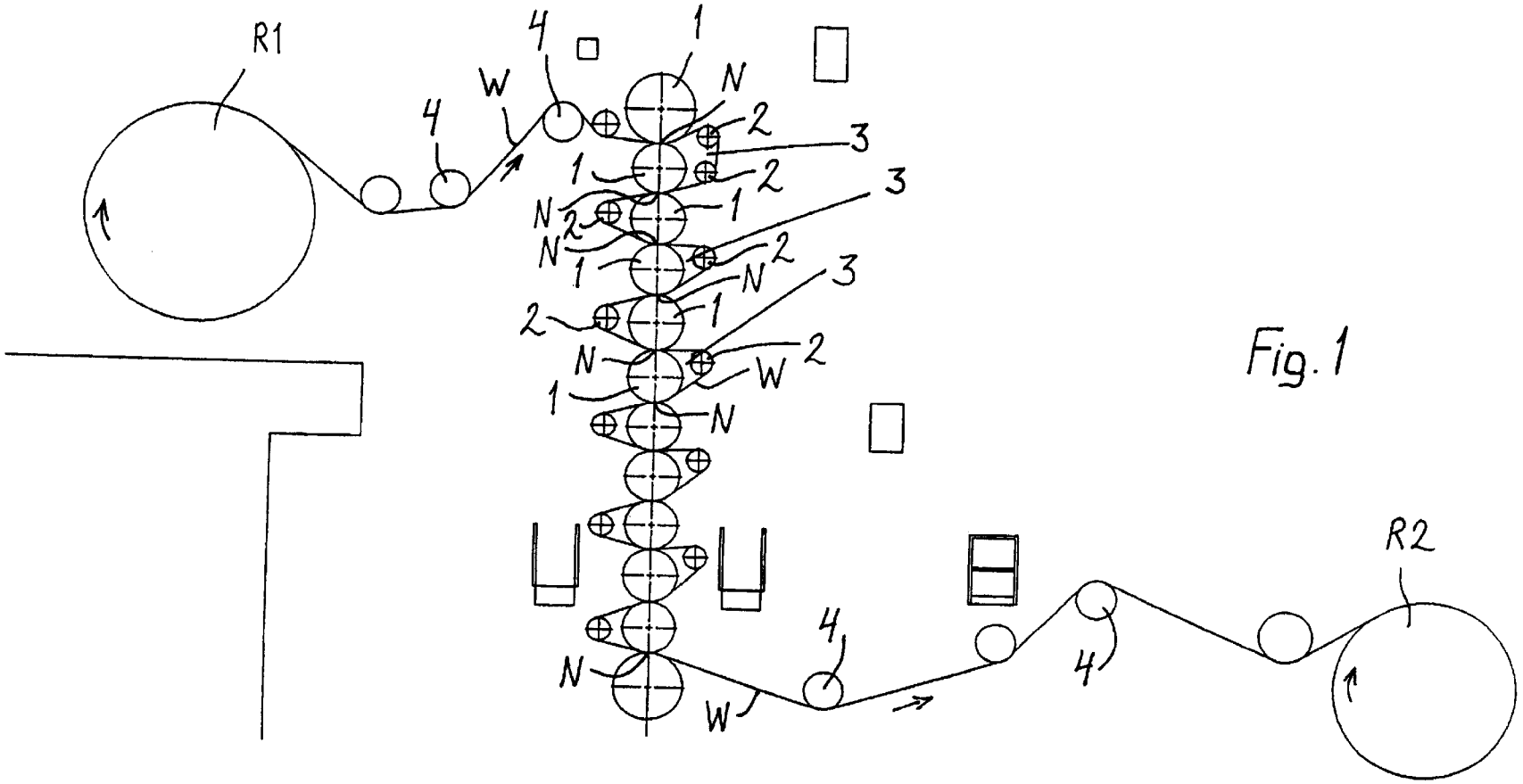
FIG. 1 shows a typical calender roll assembly, in connection with which the invention can be used.

FIG. 1 shows a typical calender roll assembly in connection with which the invention can be used. The calender comprises a stack of calender rolls composed of superimposed calender rolls 1, in which calender nips N are formed between the calender rolls 1. The paper web W to be calendered travels via successive nips, i.e. to the first, upper nip N and thereafter via the nips formed above and below the next lower calender rolls, and after it has traveled down through the calender roll assembly, it exits the assembly through the last, lowermost nip N. The web travels along a winding path through the calender in such a manner that after each nip N it is taken off the surface of the calender roll 1 following the nip N by means of a take-out leading roll 2, wherein web loops are formed alternately on both sides of the stack of calender rolls, said web loops being limited by the run of the web leaving the nip N between an upper calender roll 1 and a lower calender roll 1 for a take-out leading roll 2, the surface of the take-out leading roll 2, the run of the web leaving the take-out leading roll 2 for the nip N between the lower calender roll 1 and a calender roll 1 therebelow, as well as by the free shell of the lower calender roll rotating between the aforementioned nips N, from which shell the web is separated by means of said take-out leading roll 2. The air pockets formed inside the web loop traveling between the nips above and below the same calender roll N, are marked with the reference numerals 3 in FIG. 1. In the calender, some of the rolls 1 are hard-surfaced metal rolls, and some of them soft rolls. Some of the rolls are heated.

FIG. 1 shows how the web W is calendered in a multinip calender in an operation separate from the paper production machine, i.e. in off-machine calendering, wherein it is guided from a paper reel R1 to be discharged to the uppermost nip N of the calender, and from the lowermost calender nip N to the reel-up on a paper reel R2. Between the reel R1 that is being discharged and the uppermost nip of the calender, as well as between the lowermost nip of the calender and the reel R2 that is being formed, the run of the web is guided by means of web guiding rolls 4. The invention is not, however, restricted solely to a process similar to the one shown in FIG. 1, but it can be used in all multinip calendering processes in which the web is taken out from the stack of calender rolls, as in the on-line multinip calendering after the drying section in a paper production line.

The figure shows a calender containing twelve calender rolls 1 and eleven calender nips N, but the invention can also be used in multinip calenders with a different number of calender rolls and calender nips.

In the following, the phenomena of one air pocket 3 are described in more detail in solutions according to the state of the art.

Figure 2:
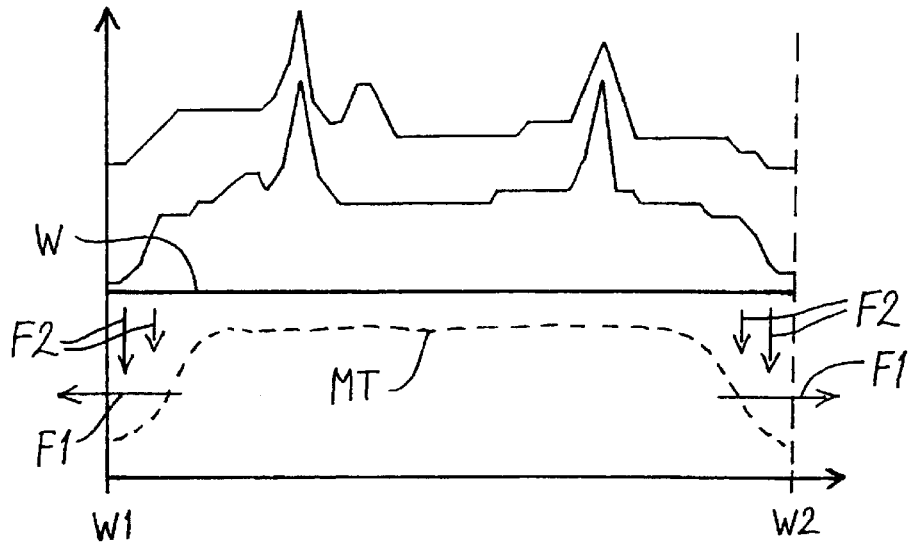
FIG. 2 is a cross-directional graph of the web showing the phenomena effective in the calenders according to the prior art.

FIG. 2 schematically shows the moisture, heat and flow conditions of an air pocket which is open on its ends. The X-axis illustrates the width of the web, and the outer edge of the web is indicated with symbols W1 and W2. The paper web is described schematically with a horizontal line segment W. The humidity or temperature of the air inside the pocket is illustrated with a broken line MT, and it can be seen in the graph that it forms a profile which rises towards the middle from the edges. A balanced state prevails in the middle area located inwardly from the edges W1, W2, and the edge area has a moisture content and temperature gradient descending towards the outer edges. This causes a moisture mass flow and a heat flow in the edge areas, outward from the pocket, which flows are designated with arrows F1. The profile descending in the edge areas, in turn, causes the transfer of moisture and heat in the edge area of the web W from the web to the air in the air pocket, and the closer the outer edge W1, W2 is, the stronger the transfer becomes. In the edge areas the moisture evaporated in the air pocket or the heat transferred is designated with arrows F2.

In FIG. 2 the graphs above the paper web W illustrate the temperature profiles measured from the paper web in a multinip calender. In addition to the temperatures falling towards the edges, they also show clear peaks in the middle area, which peaks refer to the heat generation of the bearings located at corresponding points in the take-out leading rolls. At the worst, a strong cooling in the edge areas and the heating caused by the uneven heat development in the middle area cause a very uneven temperature profile of the web.

Figure 3:
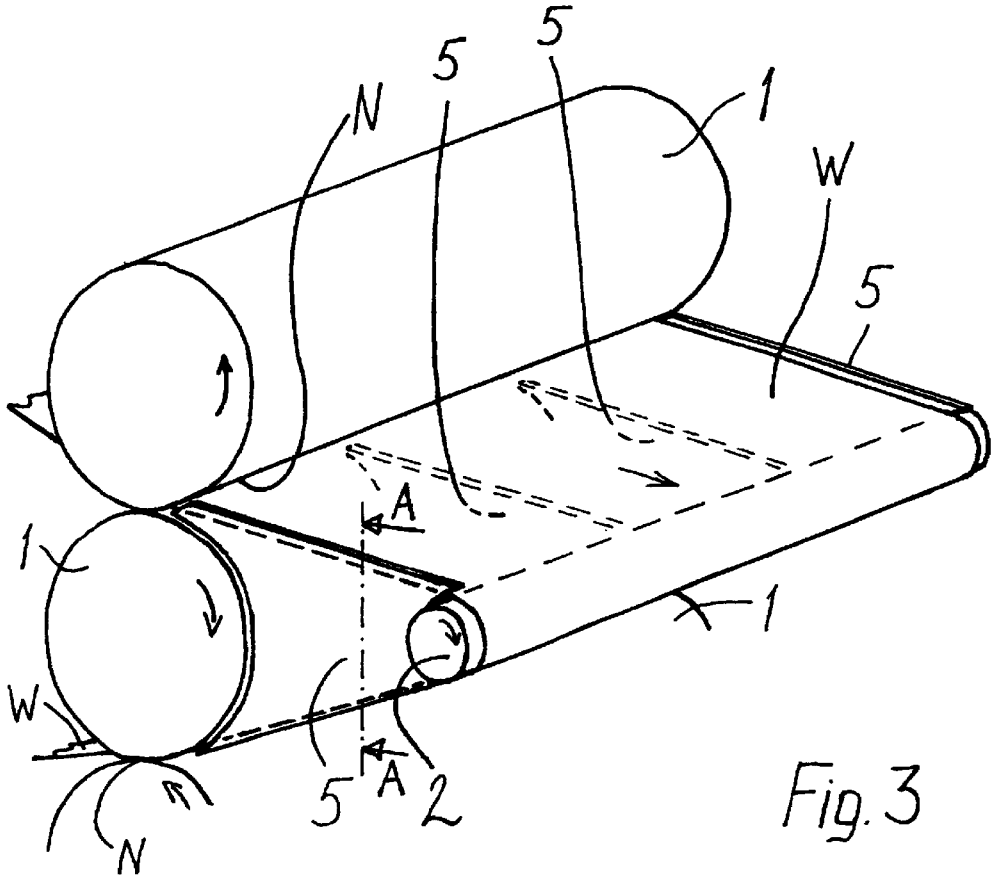
FIG. 3 is a perspective view showing the device according to the invention in connection with an air pocket formed inside the web loop.

FIG. 3 shows a perspective view of one above-described web loop, inside which an air pocket 3 is formed, said air pocket having associated therewith a device by means of which it is possible to better control the conditions in the air pocket. In connection with the air pocket 3 there are obstacles 5 arranged to restrict the air flows in the cross-direction of the web W inside the air pocket and at the same time the transfer of heat and/or moisture in the cross direction of the web. The obstacles are either obstacles closing the open ends of the air pockets partly or entirely, being placed perpendicularly to the plane of the web W, or they are partitioning obstacles placed inside the pocket, closing the open inner space of the pocket in the cross direction entirely or partly. For this purpose the obstacles extend to the area of the free cross section of the pocket (cross section perpendicular to the axis of the take-out leading roll 2), which is outside the box structures or the like possibly located inside the pocket. Advantageously, end walls closing at least both ends of the pocket partly or substantially entirely are used, wherein a closed air space separated substantially from the outer air is formed inside the pocket, by means of which it is possible to prevent the transfer of heat and/or moisture outside via the edges from inside the air pocket 3. Compared with the encapsulation of the entire calender, the conditions are stabilized with lighter and simpler structures at those points of the calender which are important in view of the development of different profiles of the web.

Advantageously, inside the air pocket 3 which is closed at its ends by means of obstacles, partitioning obstacles 5 are also used, by means of which the air pocket can thus be accurately divided into zones, thus preventing the flows and the transfer of heat and moisture in the closed air pocket from a given zone to another inside the edges of the web.

The obstacles can comprise control gates or the like to attain desired movements of air.

Figure 4A:
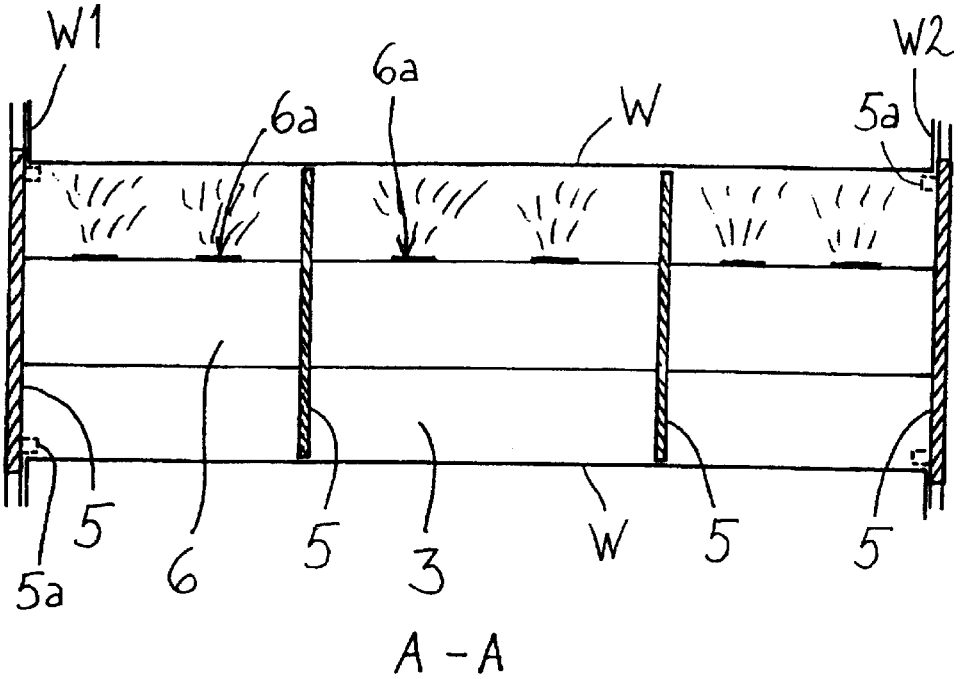
FIGS. 4*a* to 4*c* show the same in a vertical section taken in the direction of the axis of the take-out leading roll, in addition to which they present control devices for affecting the conditions of the air pocket.

FIG. 4*a* shows in more detail the aforementioned principles as a cross section of the air pocket, cut along the line A—A of FIG. 3, parallelly with the axis of the take-out leading roll 2. FIG. 4*a* shows both the end walls closing the ends and functioning as obstacles 5 sealing the air pocket 3 from the external heat and moisture conditions, and the partitioning walls placed inside these end walls, functioning as obstacles 5 restricting the air flows and the transfer of heat and moisture in the cross direction of the web W. By arranging the obstacles 5 at least at the ends of the air pocket 3, it is possible to eliminate the moisture and temperature deviation commonly occurring in the edge areas, or it is at least reduced considerably due to the fact that the same temperature and humidity of air prevails across the entire width of the air pocket, or the gradient is at least considerably more gently sloping than in such a case where the ends are open. The obstacles 5 at the ends can be plate-like walls which are located outside the outer edges W1, W2 of the web W in such a manner that only a small gap, possibly under 2 cm, remains between said walls and the outer edges of the web. Small leak flows which possibly occur can be reduced by arranging sealing constructions inside the wall, such as for example sealing bars parallel to the run of the web e.g. inside the web loop. Such sealing bars, which are located on the inner surface of the end wall, are marked with broken lines 5*a*.

In the above-described manner it is possible to even out the moisture and temperature profile of the web by means of passive procedures, in other words, by means of restricting structures that are fixed at least during calendering. The temperature and moisture conditions prevailing inside the air pocket 3 are not necessarily affected by special control procedures. FIG. 4*a*, however, also shows an active control device 6, which is placed inside the air pocket 3, in the area between the obstacles 5 in the ends. The control device 6 can be brought for example through the end wall located in one end, and it can be supported by its opposite end to the end wall in the opposite end. The control device is a profiling control device by means of which it is possible to zonewise affect the temperature and moisture conditions inside the pocket, and it can be a device functioning on a principle known as such being able to increase the moisture and/or heat inside the air pocket 3 in an accurately determined area in the lateral direction of the web. Such a control device can be for example a profiling steam box. Furthermore, the control device 6 can be utilized for fixing the obstacles 5 inside the pocket, i.e. these obstacles, such as the platelike like partitioning walls or the like extending substantially perpendicularly to the web, can be fixed to the control device 6 extending in the lateral direction of the pocket. The control device 6 contains openings 6*a*, from which steam is supplied to the air pocket 3 and to the web W. If the control device is a structure which is supported in its position by supporting means of its own, the obstacles 5 can be fixed to the end of the control device 6 in such a manner that they either partly or entirely close the free area that remains in the air pocket 3 outside the control device 6 and forms an open end of the air pocket 3.

By means of the aforementioned profiling control device 6 it is, for example, possible to remove the aforementioned deviations occurring in the middle area of the air pocket, such as the temperature peaks presented in FIG. 2, which are positioned at the location of the bearings of the take-out leading rolls 2. In each zone limited by the obstacles 5 there may be for example one or more openings 6*a* for supplying steam to the web.

The control device 6 shown in FIG. 4*a* can function on many principles, and it is not restricted to steaming devices or steam boxes known as such. Especially in connection with the air pocket 3 which is closed on all sides, it is possible to use a control device 6 by means of which heat can be efficiently brought to the pocket and directed for example to the calender roll 1 limiting the pocket, i.e. to the free shell of the calender roll 1. By means of the control device 6 it is for example possible to efficiently heat the surface of the calender roll 1 functioning as a thermoroll. In particular, the control device 6 is of such a type that it increases both the surface temperature of the calender roll 1 and the humidity of the air which is in contact with the inner surface of the web W travelling around the pocket. By means of a heater arranged in connection with the closed pocket it is possible to efficiently utilize energy, for example the energy which cannot be utilized in the calender roll 1 remains in the air pocket 3 and is transferred therefrom to the web W.

Figure 4B:
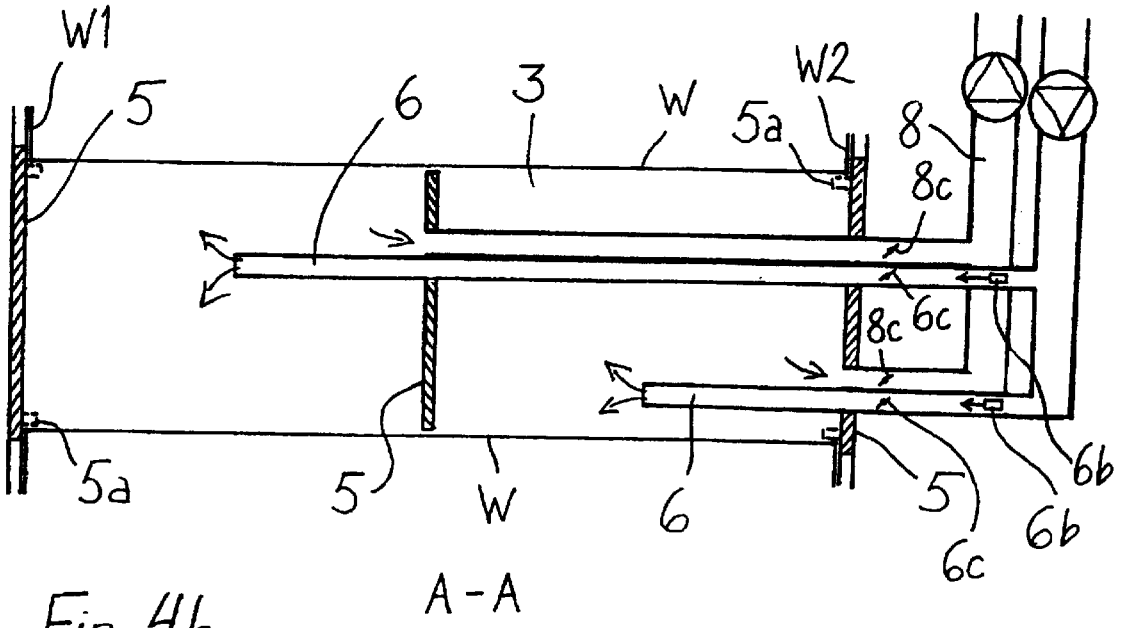

FIG. 4*b* shows an embodiment with a compartment-specific inlet air and exit air arrangement. By means of such an arrangement it is possible to adjust the air space conditions in the pocket in the cross direction by supplying suitable amounts of suitably humid and warm air and by removing suitable amounts of air from the pocket. In this way it is also possible to adjust the air pressure prevailing in the pocket, for example by setting a slight overpressure in the pocket. FIG. 4*b* shows an inlet air pipe, which branches in the form of inlet air channels 6 at least into two compartments separated from each other, and an exit air pipe, which is branched into the same compartments as the inlet air pipe. The inlet air can be issued from an air moisturizer device, for instance from steam moistening or gas burners. As can be seen in FIG. 4*b*, these can be located in the inlet air channels (pipe branches) leading to the respective compartments, and they are marked with the reference numeral 6*b*. Reference numerals 6*c* and 8*c* indicate the flow control device, for example a pivotable flap located in each inlet air channel and exit air channel. The inlet air can be taken from the hood of the paper machine, wherein the exit air can also be supplied back to the hood. The moisturizer or burner can be common to all inlet air channels (pipe branches), wherein a different moisture level and/or heating level in the cross direction is attained by means of the flow control devices 6*c*, 8*c*.

Figure 4C:
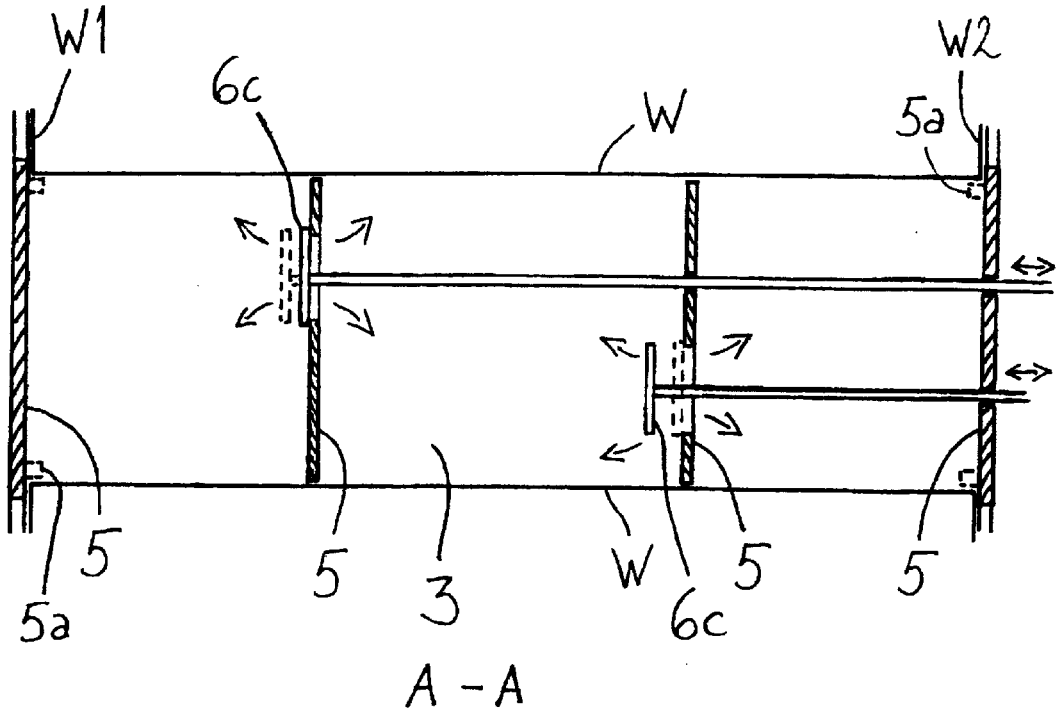

FIG. 4*c* shows an embodiment, in which the partitioning walls 5 are arranged partly openable for example by means of a suitable air valve 6*c* or the like, adjusting the flow opening, wherein the air flow between the compartments is possible and the temperature and/or moisture difference between the compartments can be equalized. Each of these compartments can be provided with separate means for heating or moistening the air therein (not shown), wherein adjustable openings or gates in the partitioning walls 5 provide for an additional adjustment possibility.

Some of the preceding figures show two compartments, and some of them three compartments in the pocket 3, but it is obvious that there may be a larger number of compartments, and the number of them can be arranged suitable for example according to the desired profiling accuracy.

As was mentioned above, according to one embodiment, the control device 6 is a gas burner. The gas burner may be an infra-type radiator, 10 or a conventional burner. The gas burner may also be profiling. When gases composed of carbon and hydrogen, for example natural gas or liquefied gas, are burned in the gas burner, the result of the combustion reaction is carbon dioxide and water. Thus, both thermal energy and moisture is generated in the pocket, and the need for additional wetting by separate wetting devices can be reduced. The moisture obtained from the burning of gas can be utilized so that even over 40% of the total need for wetting is produced. The following example, which in no way restricts the invention, illustrates the possibility to use the burning process. When natural gas or liquefied gas is burned in the gas burner, the combustion reaction generates carbon dioxide and water. When 1 kg (12.8 kWh) of propane is burned, 1.64 kg of water is generated, and when 1 kg of natural gas (13.8 kWh) is burned, 2.3 kg of water is generated. The required amount of wetting is approximately 0.5–1.5 g/m$^2$. If the running speed of the calender is assumed as 600 m/min and the total amount of additional heat supplied therein as 50 kW/m, the amount of water obtained by burning natural gas is 8.4 kg/hour/metre of width. If the wetting need is 0.5 g/M$^{2\times}$600 m/min ×60 min=18 000 g/h/meter of width, the moisture obtained from the gas would with this wetting requirement be even 46% of the total requirement.

When a burning device is used as a control device 6, it is possible to utilize one burning device or several burning devices, wherein the pockets or parts of the pockets can be provided with a profiled flow in a manner shown in FIG. 4*b*. The burner or burners may be located either outside the pocket, as seen in FIG. 4*b*, or inside the same, wherein they can function as radiating heaters as well.

Figure 5:
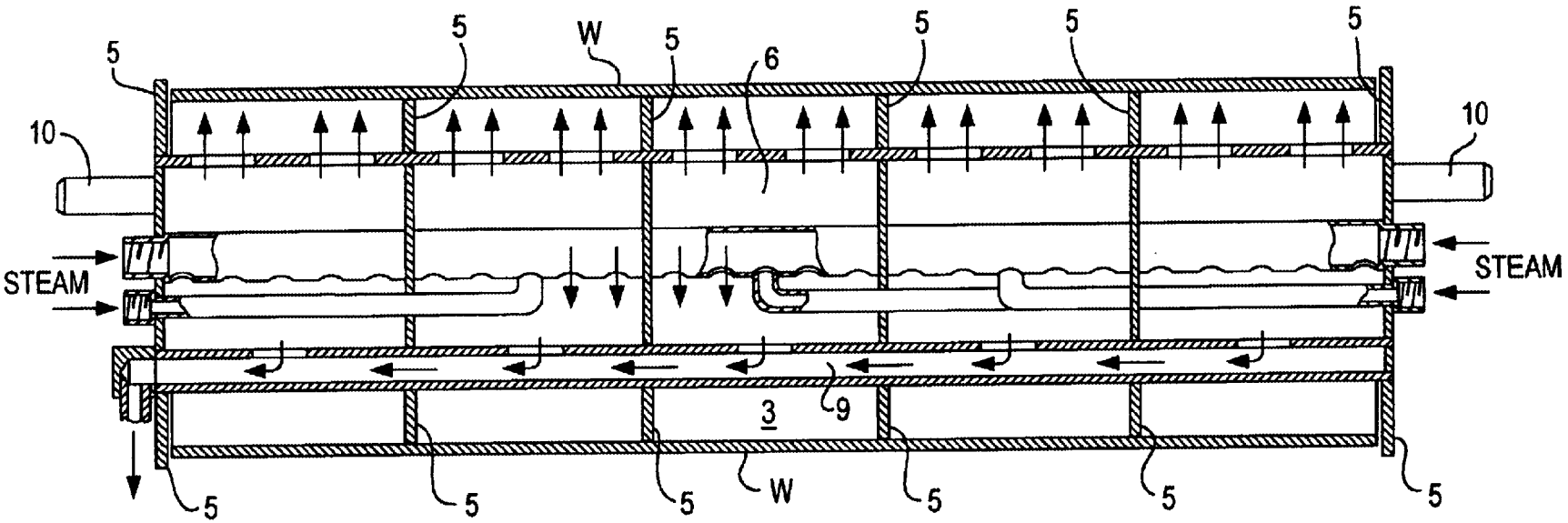
FIG. 5 shows an embodiment in a vertical section taken in the direction of the axis of the take-out leading roll.

FIG. 5 also shows a control device 6 for controlling the moisture and/or heat in the pocket, which in this case is a steam box provided with end walls 5 and partitioning walls 5 mounted thereon to prevent air flow in the cross direction of the web. By means of this arrangement it is possible to control the state of the air within the pocket particularly well and to affect the moisture profile in the cross direction actively. The steam box can be e.g. of the type presented in the patent publication U.S. Pat. No. 4,642,164, wherein it comprises steam. pipes ending in a distribution pipe in each compartment, along which steam pipes the steam is conveyed. To collect condensate, there is a collector pipe 9 extending through every compartment. The steam box is supported at its ends by supporting means 10, as a result of which the steam box at the same time supports the compartmenting end walls and partitioning walls 5 located between the box and the web.

Figure 6:
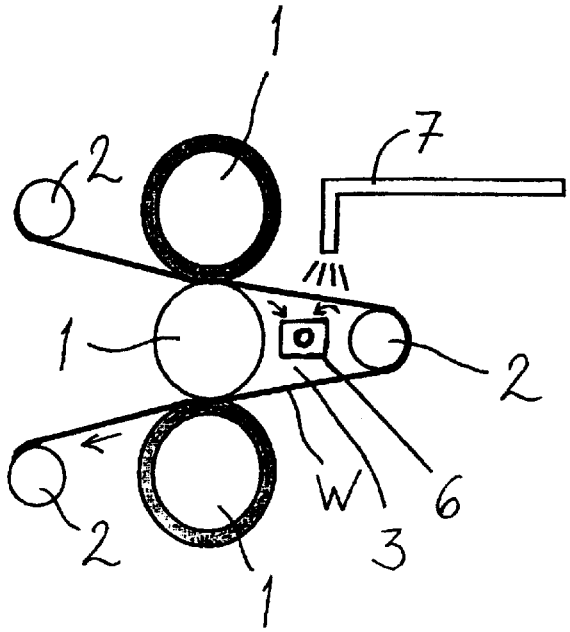
FIG. 6 shows a schematical side-view of yet another way of affecting the conditions inside the air pocket according to the invention.

FIG. 6 shows yet another manner of utilizing the closed air pocket 3 formed inside the web loop. In connection with this it is possible to use a control device 6 which is of similar type as the one described hereinabove in connection with FIG. 4, but in this case the control device 6 generates a negative pressure in the air pocket 3, i.e. it is connected to suction. The negative pressure can also be generated in a profiled manner, because the air pocket is divided into compartments in the area inside the obstacles 5 in the ends, i.e. the air pocket contains zones whose pressures differ from each other. The negative pressure which is the same or different zonewise inside the air pocket is utilized in this embodiment in the wetting conducted from outside the web loop by means of a wetting device 7, which can be a spraying device, or a device issuing steam. Due to the negative pressure inside the pocket 3, an air flow directed towards the pocket through the web W is generated as a result of the pressure difference between the external normal air pressure (the ambient air pressure of the machine hall) and the negative pressure. In this way the diffuse convection of the water vapour emitted from the paper can be reduced, and the outward net mass flow of the moisture can even be stopped. Thus, the wetting procedures exerted on the outer surface of the web W outside the pocket can be utilized for increasing the moisture of the web in the area between the roll nips N. As is shown in FIG. 6, the wetting is conducted advantageously in the section of the web leaving the calender nip N, i.e. in the travel direction of the web in the area between the nip N and the take-out leading roll.

By arranging the negative pressure inside the pocket 3 in a "profiled" manner, it is possible to affect the wetting outside the web also in a profiled manner in such a case where a uniformly moistening wetting device 7 is used. The wetting can also be conducted in such a manner that the negative pressure in the pocket 3 is constant in the lateral direction of the web, and the external wetting device 7 is profiling. It is also possible to use a combination of a profiled negative pressure and a profiling external wetting device 7.

As can be seen in FIG. 1, the calender contains several air pockets 3, in connection with which it is possible to use some of the aforementioned embodiments. The invention can be used in connection with one or more air pockets. It is advantageous to use the invention in connection of at least two air pockets, one of which can be located close to the first calender nip N, and the other close to the last calender nip N. Furthermore, in different air pockets 3 of the same calender it is possible to use embodiments whose principles differ from each other. Moreover, it is possible to use obstacles 5 closing the open ends in all air pockets 3 formed by the web loops, even if special control devices 6 are not used in connection with all air pockets. Thus, it is made possible that the profile remains even also at the location of those air pockets 3 which follow the air pockets 3 in which special control devices 6 are used for affecting the moisture and/or temperature conditions inside the pocket.

It is also possible that the open ends of the air pockets 3 are closed by means of obstacles 5 to which a device controlling the moisture and/or temperature is integrated, said device being thus able to affect the conditions in the pocket 3 from the ends. Also according to this alternative, the profiling is possible if there is at least one partitioning wall inside the pocket 3 between the control devices integrated to the end obstacles.

What is claimed is:

1. A method for leading a web, comprising the steps of:

providing a plurality of calender rolls, said plurality of calender rolls defining a calender roll nip (N) between each of said calender rolls;

providing a plurality of leading rolls, each of said plurality of leading rolls positioned apart from a respective each one of said plurality of calender rolls to thereby define a web loop between each one of said calender rolls and each one of said leading rolls, wherein said web loop includes a first open end and a second open end;

guiding the web between the calender roll nips (N) in the web loop by said plurality of leading rolls, wherein inside said web loop an air pocket (3) is formed between said first open end and said second open end, and controlling a moisture mass and/or heat flow in the air pocket (3) in a cross direction of the web;

wherein the moisture mass and/or heat flow is substantially prevented by a first end wall positioned at said first open end and a second end wall positioned at said second open end to thereby close the open ends of the air pocket (3) and substantially seal the airpocket.

2. The method according to claim 1, wherein the moisture mass and/or heat flow within the air pocket is restricted in a cross direction of the web by at least one obstacle, said at least one obstacle is arranged between said first end wall and said second end wall.

3. The method according to claim 1, wherein heat and/or moisture is actively brought into the air pocket (3).

4. The method according to claim 3, wherein at least part of the heat and/or moisture originates from a burning process.

5. The method according to claim 3, wherein heat is brought to an entire width of the air pocket (3).

6. The method according to claim 3, wherein moisture is brought to an entire width of the air pocket (3).

7. The method according to claim 1, wherein negative pressure is arranged in the interior part of the air pocket (3) and moisture is introduced on the outer surface of the web (W) on the opposite side.

8. A calender; comprising:

a plurality of calender rolls (1), said plurality of calender rolls define a calender roll nip (N) between each of said calender rolls;

a plurality of guiding devices, said plurality of guiding devices being structured and arranged to guide a travel of the web (W) between the nips (N), each one of said plurality of guiding devices being positioned apart from a respective each one of said plurality of calender rolls to thereby define a web loop between each one of said calender rolls and each one of said guiding devices, wherein said web loop includes a first open end and a second open end and wherein said web loop defines an air pocket (3) between said first open end and said second open end; and a first end wall positioned at said first open end and a second end wall positioned at said second open end. said first and second end walls restrict an air flow in the air pocket thereby restricting the mass and/or heat flow in the air pocket in a cross direction of the web (W).

9. The calender according to claim 8, wherein at least one obstacle (5) is placed inside the air pocket (3) between said first end wall and said second end wall, said at least one obstacle extending perpendicular to the web thereby closing an open inner space of the air pocket partly or entirely, the obstacle possibly extending from a box structure located in the pocket and extending in the cross direction of the web (W).

10. The calender according to claim 9, wherein the at least one obstacle is placed in connection with at least two different air pockets (3) in the calender.

11. The calender according to claim 10, wherein in the calender, the open ends of at least two different air pockets (3) are closed partly or entirely by means of the obstacles (5).

12. The calender according to claim 10, wherein the control device (6) is placed inside at least two different air pockets (3) to control the temperature and/or moisture conditions prevailing in said air pockets (3).

13. The calender according to claim 8, wherein the air pocket (3) in said web loop is divided into two or more compartments in the cross direction of the web (W).

14. The calender according to claim 8, wherein a control device (6) is placed inside the air pocket (3), said control device (6) being arranged to affect the temperature and/or moisture conditions of the air pocket (3).

15. The calender according to claim 14, wherein the control device (6) is arranged to supply heat and/or moisture inside the air pocket (3).

16. The calender according to claim 14, wherein the control device (6) is connected to negative pressure and outside the air pocket (3) there is a supply device (7) arranged to supply moisture to the surface of the web (W).

17. The calender according to claim 14, wherein the control device (6) is a profiling control device.

18. The calender according to claim 15, wherein the control device (6) is a steam supply device.

* * * * *

UNITED STATES PATENT AND TRADEMARK OFFICE

CERTIFICATE OF CORRECTION

PATENT NO. : 6,694,870 B1
DATED : February 24, 2004
INVENTOR(S) : Reijo et al.

It is certified that error appears in the above-identified patent and that said Letters Patent is hereby corrected as shown below:

Title page, Item [54] and Column 1, line 1-2,
Title, should read -- METHOD FOR LEADING A WEB BETWEEN CALENDER NIPS, AND A CALENDER --.

Signed and Sealed this

Twenty-second Day of June, 2004

JON W. DUDAS
*Acting Director of the United States Patent and Trademark Office*